United States Patent [19]

Allbritton

[11] 4,206,614

[45] Jun. 10, 1980

[54] ICE PRODUCING APPARATUS

[76] Inventor: Harold L. Allbritton, P.O. Box 206, Greenwood, La. 71033

[21] Appl. No.: 941,038

[22] Filed: Sep. 11, 1978

[51] Int. Cl.[2] ..... F25C 1/12

[52] U.S. Cl. ..... 62/233; 62/347; 62/380

[58] Field of Search ..... 62/347, 74, 345, 380, 62/353, 233, 72

[56] References Cited

U.S. PATENT DOCUMENTS

| | | | |
|---|---|---|---|
| 1,857,122 | 5/1932 | Sherman | 62/345 |
| 2,026,214 | 12/1935 | Chilton | 62/353 |
| 2,054,073 | 9/1936 | Field | 62/72 X |
| 2,432,597 | 12/1947 | Toulmin, Jr. | 62/345 X |
| 3,146,601 | 9/1964 | Gould | 62/347 X |
| 3,254,501 | 6/1966 | Brysselbout | 62/347 X |
| 3,285,029 | 11/1966 | Pansing | 62/345 X |
| 3,309,892 | 3/1967 | O'Connell et al. | 62/345 |
| 4,107,943 | 8/1978 | Ohling | 62/347 X |

*Primary Examiner*—Albert J. Makay
*Assistant Examiner*—William E. Tapolcai, Jr.

[57] ABSTRACT

An ice producing apparatus characterized by a refrigerant compresser, a condensor coil, a receiver tank, a solenoid valve, an evaporator, a water spray system and an endless ice grid positioned to traverse the evaporator, which in combination operates to permit a gaseous refrigerant to vaporize in the evaporator, condense in the condensor, collect in the receiver and selectively flow back into the evaporator through the solenoid valve to facilitate freezing of ice in the endless belt ice grid and collecting the ice. The grid selectively moves adjacent to and beneath the evaporator during the harvesting cycle, and collects ice from water which is sprayed on the underside of the grid and against the evaporator during the apparatus freezing cycle. Ice is selectively removed from the ice grid in the harvesting cycle when warm refrigerant is permitted to flow from the receiver tank into the evaporator by automatic operation of a timer and a cooperating solenoid valve.

7 Claims, 6 Drawing Figures

ICE PRODUCING APPARATUS

BACKGROUND OF THE INVENTION

1. Field of the Invention

This invention relates to a new and improved apparatus for freezing and collecting ice, and more particularly, to a new and improved ice manufacturing apparatus which facilitates the formation of ice by spraying a stream of water on the bottom of an ice grid positioned adjacent to and beneath an evaporator coil. The apparatus utilizes a condensor and compresser system in combination with a receiver tank and evaporator, and a water system which includes spray nozzles for impinging water on the ice grid as the grid is located in proximity to the evaporator during the freezing cycle. The system refrigerant is recycled in such a manner as to permit warm refrigerant to flow from the receiver tank through a solenoid valve to the evaporator at a predetermined time in order to loosen the ice grid from its position adjacent to the evaporator and permit the ice to be collected during the apparatus harvesting cycle. Orchestration of advancement of the ice grid with the flow of the warm refrigerant from the receiver tank to the evaporator during the harvesting cycle is achieved by means of a timing device and solenoid valve combination.

2. Description of the Prior Art

Heretofore various systems for producing ice by automatic means have been utilized. Typical of such automatic ice producing apparatus known in the prior art is that described in U.S. Pat. No. 2,432,597 to H. A. Toulmin, Jr., which device utilizes a compartmented rubber belt which moves through a freezing chamber after collecting water in the compartments, and facilitates harvesting of the ice by means of a hopper located at one end of the machine. It is significant that the compartments in the rubber belt are filled with water from a downwardly projecting filling tube located above the belt prior to entry of the belt into the freezing chamber. A similar contact freezing apparatus is described in U.S. Pat. No. 3,618,334 to Hans Gram Vojens, which device uses elongated freezing elements arranged side by side in the form of an endless band with the freezing medium circulated through each freezing element to produce ice. Another prior art device is the continuous belt freezer with removable compartments described in U.S. Pat. No. 3,719,055 to Gail C. Shapley, et al. This belt freezer includes a flat, continuous belt and one or more flat grid units of selected length and breadth, which are placed on the belt to form pockets for water or other product to be jelled prior to freezing. The individually frozen product units formed in the grid are separated from the belt and grid as the belt moves downwardly and the grid continues forwardly from the discharge end of the freezer.

It is noted that in most of the prior art ice producing apparatus utilizing endless belts, the water or other product medium is introduced into the belt or grid arrangement at the top of the belt. The belt then moves through a freezing unit or compartment or is otherwise subjected to close association with a refrigerant, and the ice is harvested in the final cycle after freezing occurs. Many of these devices are characterized as "tunnel" type freezers, and some have been in use for many years.

It is therefore an object of this invention to provide an automatic ice cube apparatus which may be generally described as a contact freezing apparatus and which is characterized by a great efficiency, uniformity and rapidity of ice formation, and high reliability.

Another object of this invention is to provide a new and improved ice manufacturing apparatus which utilizes a continuous belt grid with the freezing medium sprayed on the underside of the grid as the belt is subjected to a freezing cycle while in position adjacent to and beneath an evaporator coil.

A still further object of this invention is to provide a new and improved contact freezing apparatus which is characterized by a compresser, a condensor coil, a receiver tank, a solenoid valve, an evaporator coil, and a water supply and spray means for spraying water on the endless belt while the belt is adjacent the evaporator during the freezing cycle, and which causes ice to loosen and the belt to move by flowing warm refrigerant from the receiver into the evaporator at a predetermined time during the ice harvesting cycle.

Yet another object of this invention is to provide a new and improved automatic ice producing apparatus which includes a flooded system characterized by a liquid line having a solenoid valve therein for intermittantly interrupting the flow of refrigerant to segregate the freezing cycle from the harvesting cycle.

Yet another object of this invention is to provide an ice cube manufacturing apparatus which utilizes a receiver for collecting warm refrigerant and a solenoid valve and timing device to cause the warm refrigerant to flow from the receiver into an evaporator to harvest ice cubes formed from the spraying of water onto an area of an endless belt grid positioned adjacent and beneath the evaporator.

Another object of this invention is to provide an improved ice producing apparatus which is characterized by an endless belt grid having discrete compartments and having a segment always positioned beneath and adjacent an evaporator coil to facilitate freezing of water sprayed upwardly against the grid during the freezing cycle and harvesting of the ice responsive to flow of warm refrigerant into the evaporator from a receiver during the harvesting cycle.

SUMMARY OF THE INVENTION

These and other objects of the invention are provided in an ice producing apparatus which includes a refrigerant condensor, evaporator, and compresser with a receiver tank and solenoid valve for receiving liquid refrigerant from the condensor and supplying warm refrigerant to the evaporator during the harvesting cycle, with gaseous refrigerant supplied to the compresser from the evaporator; an endless belt grid having one segment positioned adjacent to and beneath the evaporator; and a water supply and spray system for delivering a spray of water against the grid and evaporator during the freezing cycle to produce ice in the grid.

BRIEF DESCRIPTION OF THE DRAWINGS

The invention will be better understood in view of the following description presented with reference to the accompanying drawings.

DESCRIPTION OF THE PREFERRED EMBODIMENT

Figure 1:
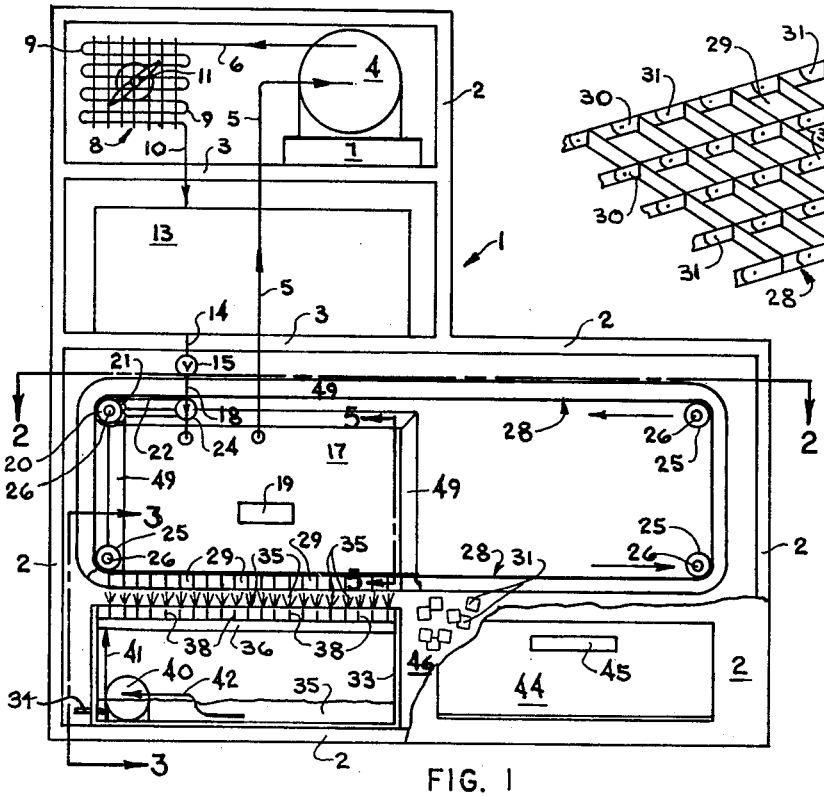
FIG. 1 of the drawing is a front elevation, partially in section, of a preferred embodiment of the ice producing apparatus of this invention.
Figure 5:
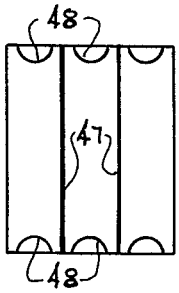
FIG. 5 is an end sectional view of the evaporator illustrated in FIG. 1 taken along lines 5—5.
Figure 6:
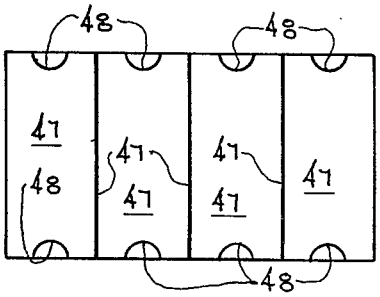
FIG. 6 is a side sectional view of the evaporator illustrated in FIG. 2, taken along lines 6—6.

Referring now to FIGS. 1, 5 and 6 of the drawing, the ice producing apparatus of this invention is generally illustrated by reference numeral 1, and includes a housing 2, which further includes interior supports 3 to carry the working components of the apparatus. An ice access door 44, equipped with a handle 45, is provided in the lower portion of housing 2 to provide access to ice storage area 46. A compresser 4 is mounted on compresser pad 7 with compresser suction line 5 communicating between compresser 4 and an evaporator 17, which is generally rectangular in shape and contains several plates 47, fitted with plate apertures 48, as illustrated in FIGS. 5 and 6. Plates 47 are preferably welded to the sides and ends, respectively, and serve to strengthen evaporator 17, while the top ones of plate apertures 48 effect equal distribution of pressure above the liquid level of refrigerant inside evaporator 17, and the bottom apertures permits an equalizing of the refrigerant liquid level. Compresser 4 is also fitted with compresser discharge line 6 which communicates with the condensor coil 9 of a condensor 8, which is cooled by condensor fan 11, as illustrated. Condensor discharge line 10 is in communication with a receiver tank 13, located immediately below condensor 8 and compresser 4. A receiver tank discharge line 14 is fitted to the bottom of receiver tank 13, and communicates with a solenoid valve 15. Solenoid valve 15 in turn communicates with evaporator 17 by means of evaporator inlet line 18, as illustrated. In a preferred embodiment of the invention evaporator 17 is located immediately beneath receiver tank 13, as illustrated in FIG. 1, and receiver tank 13 is generally cylindrical in shape and is fitted with plates 47 having plate apertures 48, in the same manner as evaporator 17.

Figure 4:
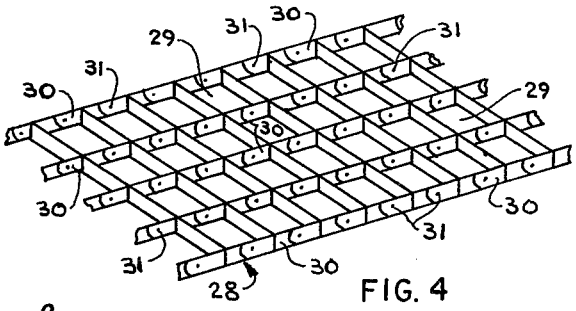
FIG. 4 is a perspective view, partially in section, of a preferred articulated ice grid belt for use in the ice producing apparatus of this invention.
Figure 2:
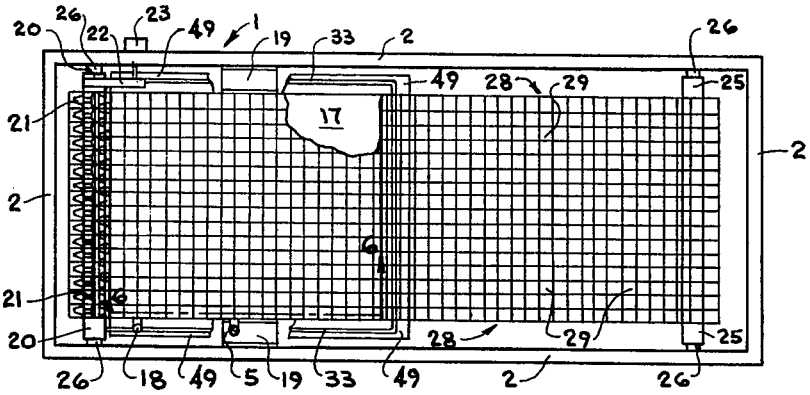
FIG. 2 is a top sectional view of the ice producing apparatus illustrated in FIG. 1, taken along lines 2—2.
Figure 3:
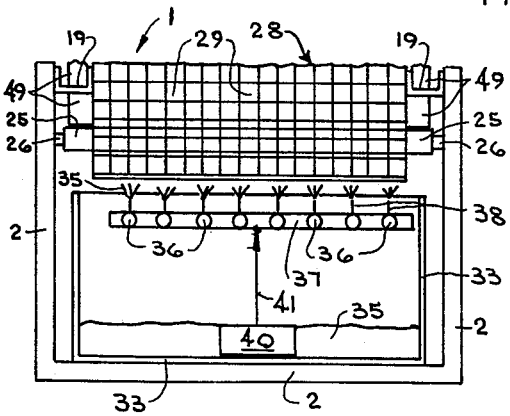
FIG. 3 is a sectional view of the ice producing apparatus illustrated in FIG. 1, taken along lines 3—3.

Referring now to FIGS. 1-4 of the drawing, it will be appreciated that in a preferred embodiment of the invention evaporator 17 is mounted in housing 2 of ice producing apparatus 1 by means of evaporator mount brackets 19, more particularly illustrated in FIGS. 2 and 3 of the drawing. An endless belt ice grid 28, a section of which is more particularly illustrated in FIG. 4, is positioned inside housing 2, and traverses three idler rollers 25 and a single drive roller 20, as illustrated.

In a preferred embodiment of the invention ice grid 28 is built of stainless steel or plastic grid segments 30, joined by grid pins 31 and positioned on idler rollers 25 and drive roller 20 such that drive roller teeth 21, on drive roller 20 rotatably mesh with grid pockets 29 of ice grid 28 to effect movement of ice grid 28 with respect to evaporator 17. However, it will be appreciated by those skilled in the art that ice grid 28 may be formed of alternative materials, including articulated aluminum and non-articulated synthetic pliable materials such as nylon and the like which may be driven in non-articulated fashion by a friction roller or rollers in lieu of drive roller teeth 21. As particularly illustrated in FIG. 1 of the drawing, ice grid 28 is positioned in close proximity to evaporator 17 such that a segment of ice grid 28 is always adjacent to the bottom of evaporator 17. Furthermore, in yet another preferred embodiment of the invention drive roller 20 is caused to move by application of drive roller belt 22, which cooperates with drive roller 20 and drive motor pulley 24, fitted to the shaft of a drive motor 23 as illustrated. Drive roller 20 and idler rollers 25 are rotatably carried by housing 2 by means of roller shafts 26, which are journalled for rotation in housing 2.

Referring now specifically to FIGS. 1 and 3 of the drawing, a water reservoir 33 is positioned immediately beneath evaporator 17 and contains a level of water 35 fed by a water inlet line 34, with the level maintained by appropriate means such as a float valve or the like, (not illustrated) according to the knowledge of those skilled in the art. Furthermore, a system of water discharge pipes 36 is positioned immediately below that segment of ice grid 28 which is adjacent the bottom freezing surface of evaporator 17, and is provided with a plurality of nozzles 38 projecting upwardly and spaced from ice grid 28. Water discharge pipes 36 are provided with a pipe header 37 which cooperates with each of the pipes in water discharge pipes 36, and serves as a source of supply of water 35. Water 35 is forced through pump discharge line 41 into pipe header 37 and through water discharge pipes 36 and from nozzles 38 by water circulating pump 40. As illustrated in FIG. 1 of the drawing, water circulating pump 40 picks up water 35 contained in water reservoir 33 through pump intake line 42, and forces it from nozzles 38 in the form of spray which impinges on that segment of ice grid 28 which is positioned adjacent to evaporator 17, as illustrated.

In operation, before the ice producing apparatus of this invention is activated, a level of refrigerant is initially maintained in evaporator 17. Upon activation of compresser 4, gaseous refrigerant is pumped from evaporator 17 through compresser suction line 5 and is discharged from compresser 4 through compresser discharge line 6 to condensor 8, as illustrated in FIG. 1 of the drawing. The pressured gas moves into condensor coil 9 and through condensor 8 where it liquifies, and the liquid moves through condensor discharge line 10, from which it is discharged as a warm liquid into receiver tank 13. During a preselected period of time while warm liquid refrigerant is flowing into receiver tank 13 solenoid valve 15 is closed. Simultaneously with the activation of compresser 4, water circulating pump 40 is activated to facilitate a spray of water 35 from nozzles 38 onto that stationary segment of ice grid 28 which is beneath and adjacent evaporator 17. As refrigerant is continuously pumped from evaporator 17 through compresser 4 and into condensor 8, the temperature of the liquid refrigerant in evaporator 17 and the evaporator itself drops below 32 degrees fahrenheit. Consequently, the water 35, cooled by recycle against the bottom freezing surface of evaporator 17, begins to freeze in grid pockets 29 as it impinges on ice grid 28 from nozzles 38. Accordingly, ice continues to form in grid pockets 29 to a thickness corresponding to the thickness of ice grid 28 during the freezing cycle for a preselected time interval. The lowered temperature of evaporator 17 is maintained both by the continued removal of gaseous refrigerant from the evaporator and by insulation 49, which surrounds evaporator 17 on five sides, as illustrated in FIGS. 1 and 2.

When the freezing cycle is completed, a timer (not illustrated) in electrical cooperation with drive motor 23 and solenoid valve 15 causes solenoid valve 15 to open, thereby permitting the warm refrigerant collected in receiver tank 15 to flow from receiver tank 13 into evaporator 17. Shortly after this occurs, the timer also activates drive motor 23, and ice grid 28 begins to move in the direction of the arrow, as illustrated in FIG. 1, the ice film which joined ice grid 28 to evaporator 17 having been melted by the entry of warm refrigerant from receiver tank 13 into evaporator 17. As ice grid 28 traverses drive roller 20 and idler rollers 25, the ice 32, formed in grid pockets 29 and illustrated in FIG. 1, begin to drop from grid pockets 29 into ice storage area 46, having been previously warmed by the refrigerant flowing into evaporator 17 and freed from grid pockets 29 by the vibration and travel of ice grid 28. Ice cubes 32 are collected in ice storage area 46 adjacent ice access door 44 for gathering as desired. This harvesting cycle continues until that segment of ice grid 28 which was adjacent the bottom freezing surface of evaporator 17 in the preceding freezing cycle has moved away from evaporator 17 and an empty segment of ice grid 28 is now positioned beneath evaporator 17. At this time drive motor 23 is stopped and solenoid valve 15 is closed by operation of the timer, and another freezing cycle begins. In a preferred embodiment of the invention water circulating pump 40 is turned off by the timer when the harvesting cycle begins and is activated when the freezing cycle begins.

It will be appreciated that during the harvesting cycle of the ice producing apparatus 1, that those ice cubes 32 which are not loosened by the horizontal movement of ice grid 28 above ice storage area 46 will be so loosened when ice grid 28 moves sharply around the lower right hand idler roller 25 from the horizontal position to the vertical position. Accordingly, this movement assures that no ice remains in ice grid 28 as it traverses the rollers and moves in time again into the freezing cycle beneath evaporator 17.

It will be further appreciated by those skilled in the art that an ice level control means of desired design either thermostatically or otherwise activated can be placed in the ice storage area 46 of the ice producing apparatus 1, in order to deactivate the freezing and harvesting cycles when the storage area is full. Furthermore, while ice grid 28 is formed to produce ice cubes as illustrated in FIG. 4 of the drawing, it will be appreciated that the belt can be shaped to produce ice of selected size and shape, as desired.

Having described my invention with the particularity set forth above, what is claimed is:

1. An ice producing apparatus comprising:

(a) A closed path conveyor belt having parallel and horizontally disposed upper and lower segments and formed of a plurality of discreet cavities open at the top and bottom;

(b) An evaporator mounted between said upper and lower segments of said belt with the bottom freezing surface of said evaporator in contact with the top of a portion of said lower segment of said belt;

(c) A receiver positioned above said evaporator for collecting warm refrigerant while said ice is forming in said cavities; conduit means communicating between said receiver and said evaporator; and valve means in said conduit means for selectively permitting said warm refrigerant to flow from said receiver through said conduit and into said evaporator to permit harvesting of said ice after said ice has formed in said cavities;

(d) Belt-drive means in cooperation with said belt for advancing said belt after said ice has formed in said cavities to position said ice above a storage area and facilitate harvesting of said ice;

(e) Water-spray means positioned beneath said evaporator and disposed to spray water into said discreet cavities and against said bottom freezing surface of said evaporator to effect formation of ice in said cavities; and (f) a timer for selective activation and deactivation of said valve means, said belt-drive means, and said water-spray means.

2. The ice producing apparatus of claim 1 wherein said conveyor belt is an articulated metal belt.

3. The ice producing apparatus of claim 1 wherein said conveyor belt is formed of a non-articulated, pliable synthetic material.

4. An ice producing apparatus comprising:

(a) a housing;

(b) an evaporator having a bottom freezing surface mounted in said housing;

(c) a plurality of rollers journalled for rotation in said housing;

(d) a closed path conveyor belt having an upper horizontal segment and a lower horizontal segment and formed of a plurality of discrete cavities open at the top and bottom and mounted on said rollers with a portion of the upper surface of said lower horizontal segment extending in contact with said bottom freezing surface of said evaporator;

(e) a receiver tank positioned in said housing above said evaporator and fitted for receiving, storing and dispensing warm liquid refrigerant;

(f) conduit means communicating from said receiver to said evaporator;

(g) solenoid valve means in said conduit means and adapted to selectively open and close said conduit means responsive to an electrical current;

(h) water spray means positioned in said housing beneath said bottom freezing surface of said evaporator and disposed to spray water into said discrete cavities and against said bottom freezing surface to effect formation of ice in said cavities;

(i) belt drive means in cooperation with at least one of said rollers for selectively advancing said belt to position said ice above a storage area in said housing after said ice has formed in said cavities during the harvesting cycle of said apparatus; and (j) timing means in electrical cooperation with said solenoid valve means, said belt drive means and said water spray means for initially closing said solenoid valve means and causing said belt drive means and said belt to stop for a selected period of time to permit said water spray means to spray water on said bottom freezing surface of said evaporator and said discrete cavities of said belt and to cause ice to form in said discrete cavities, and warm refrigerant to accumulate in said receiver, and subsequently opening said solenoid valve means to permit said warm refrigerant to flow into said evaporator and melt said ice joining said belt to said bottom freezing surface, and further causing said belt drive means to then advance said belt and harvest said ice in said storage area and cause a new segment of said belt to contact said bottom freezing surface.

5. The ice producing apparatus of claim 4 wherein said water spray means further comprises a water reservoir, a system of nozzles, and pump means for recirculating water from said reservoir through said nozzles and in said cavities in the form of spray.

6. The ice producing apparatus of claim 4 wherein said evaporator further comprises a plurality of vertically oriented plates in the interior of said evaporator and a plurality of apertures provided in the top and bottom edges of said plates to facilitate equalizing of refrigerant gas pressure in the top area of said evaporator and a uniform liquid refrigerant level in the bottom of said evaporator.

7. The ice producing apparatus of claim 4 wherein:

(a) said water spray means further comprises a water reservoir, a system of nozzles and pump means for recirculating water from said reservoir through said nozzles and in said cavities in the form of spray; and (b) said evaporator further comprises a plurality of vertically oriented plates in the interior of said evaporator and a plurality of apertures provided in the top and bottom edges of said plates to facilitate equalizing of refrigerant gas pressure in the top area of said evaporator and a uniform liquid refrigerant level in the bottom of said evaporator.

* * * * *